US006923119B1

(12) United States Patent
Frank

(10) Patent No.: US 6,923,119 B1
(45) Date of Patent: Aug. 2, 2005

(54) SHEET TRANSPORT SYSTEM FOR A ROTARY PRINTING PRESS

(75) Inventor: Hendrik Frank, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 163 days.

(21) Appl. No.: 09/696,812

(22) Filed: Oct. 26, 2000

(30) Foreign Application Priority Data

Oct. 26, 1999 (DE) ..... 199 51 382

(51) Int. Cl.[7] ..... B41F 13/24
(52) U.S. Cl. ..... 101/232; 271/205; 310/13
(58) Field of Search ..... 101/183, 232, 101/181; 271/193, 204, 205; 310/12, 13, 310/14; 318/38, 135

(56) References Cited

U.S. PATENT DOCUMENTS

| | | | | |
|---|---|---|---|---|
| 1,541,932 A | | 6/1925 | Evans | |
| 5,222,727 A | | 6/1993 | Jacobsen | 271/205 |
| 5,918,101 A | * | 6/1999 | Kuroyanagi | 270/32 |
| 5,927,194 A | | 7/1999 | Jeschke | 101/183 |
| 6,240,843 B1 | * | 6/2001 | Kruger et al. | 101/183 |
| 6,631,901 B2 | * | 10/2003 | Hess et al. | 271/205 |
| 2002/0060409 A1 | | 5/2002 | Hess et al. | 271/198 |

FOREIGN PATENT DOCUMENTS

| | | | |
|---|---|---|---|
| DE | 2501963 | A1 | 12/1975 |
| DE | 4302125 | A1 | 7/1994 |
| DE | 69204742 | T2 | 2/1996 |
| DE | 19511682 | C2 | 10/1996 |
| DE | 19837095 | | 2/2000 |
| EP | 0515336 | B1 | 9/1995 |
| SE | 53576 | * | 1/1923 |

OTHER PUBLICATIONS

U.S. Appl. No. 09/452,975, filed Dec. 2, 1999.

* cited by examiner

*Primary Examiner*—Ren Yan
(74) *Attorney, Agent, or Firm*—Davidson, Davidson & Kappel, LLC

(57) ABSTRACT

A sheet transport system for a rotary press having rails (6*a*, 6*b*) configured on both sides of a sheet transport path, driven grippers (20*a*, 20*b*) gripping a sheet (2) to be transported near its front end, viewed in the feed direction, at its side edges and pulling it through the rotary press.

13 Claims, 3 Drawing Sheets

SHEET TRANSPORT SYSTEM FOR A ROTARY PRINTING PRESS

BACKGROUND OF THE INVENTION

Field of the Invention

The present invention relates to a sheet transport system for a rotary printing press having rails configured on both sides of a sheet transport path, driven grippers being guided on these rails for pulling a sheet to be conveyed in the feed direction.

German Patent Application No. DE 4 302 125 A1 discloses a sheet transport system, where sheet grippers grip the side edges of a pre-printed sheet at a rear sheet section, viewed in the feed direction. These lateral grippers are used in cooperation with grippers which are configured on a gripper bar and which hold the front sheet edge, viewed in the feed direction, to prevent the sheet from fluttering and, thus, from colliding with parts of the printing press, thereby avoiding any blurring of the ink freshly printed thereon. These lateral sheet grippers do not execute their own driving function. Rather, they exert a force on the sheet opposite to the feed direction to ensure that the sheet is held tightly.

Since the intended use of the lateral sheet grippers of this known transport system is to protect factory-printed sheets, there is no reason to consider using them in a sheet transport system at any location other than behind the printing unit, viewed in the feed direction.

German Patent Document No. DE-OS 2 501 963 discloses another sheet transport system for a rotary press, having rails arranged on both sides of a sheet transport path. The rails have a cross bar mounted thereon, which in turn has grippers mounted thereon for gripping a front edge, viewed in the feed direction, of a sheet to be printed. With the aid of the gripper mounted thereon, this cross bar pulls a sheet to be printed through a nip between an impression cylinder and a blanket cylinder. On their peripheral surface, both cylinders have a channel-type segment, which is sized to accommodate the cross bar, including the grippers mounted thereon, as it moves through the gap.

In the case of this transport system, precise synchronization of the motion of the cylinder and cross bar is extremely important. A synchronization error can cause the cross bar and cylinder to collide in a position of the cylinder where the cross bar is not able to mate or fully mate with the channels. The result is that the cross bar becomes jammed, which can lead to considerable damage to the cross bar and to the cylinders, and possibly to their mount fixtures and driving devices as well.

One cannot obviate the danger of such collisions safely enough simply by electronically synchronizing the motion of the transport system and of the cylinders. Satisfactory operational reliability can only be achieved by a mechanical forced coupling of the parts that dip into one another, for example with the aid of gearing and/or by using a mainshaft.

A further drawback of transporting sheets using a cross bar that dips into the gap between the blanket cylinder and the impression cylinder is that the rotation of the cylinders excites vibrations in the printing press. When ink is transferred onto a sheet to be printed, the blanket cylinder and impression cylinder are pressed against each other; when the channels mutually oppose each other, such pressing does not occur. The result is a dynamic excitation of vibrations in the printing press. Since the natural frequencies of printing presses are often near their maximum rotational speeds, it is precisely this intense vibrational excitation that limits any further increase in productivity.

An additional consequence of this vibrational excitation is that the contact pressures between the impression cylinder and blanket cylinder are limited. This, in turn, limits the use of stamping dies, for example.

SUMMARY OF THE INVENTION

An object of the present invention is to provide a sheet transport system for a printing press that can be run with a high level of operational reliability, at high pressures and high speeds. This is achieved by a sheet transport system having rails which are arranged on both sides of a sheet transport path and in which driven grippers are guided for pulling a sheet to be transported in the feed direction, in that the grippers engage with side edges of the sheet near its front end, viewed in the feed direction. This measure completely eliminates the need for a cross bar and for grippers mounted thereon for pulling the sheet at its front edge. The result, of course, is that the danger of collision between the cross bar and the cylinders is eliminated.

At the same time, the channels on the blanket cylinders and printing cylinders can be completely eliminated or reduced to the extent that is essential for securing the blanket or the printing plate to these cylinders. In any case, reducing the channels lessens vibrational excitation, thereby permitting higher rotational speeds and enhancing productivity for the printing press.

A sheet transport system of this kind can run continuously between a feeder and a delivery device of the rotary press. The need is eliminated for transferring a sheet to be printed between various gripper devices while the sheet is fed through the press. Consequently, even print positioning errors resulting from errors when transferring the sheet among various gripper devices are ruled out.

Since there is no longer a danger of the grippers and cylinders of the printing press colliding, all that is needed to synchronize the motion of the grippers with that of the cylinders is an electronic control circuit.

Since the cross bar for coupling grippers holding a same sheet is eliminated, the control circuit can also be effectively used to synchronize these grippers.

Another gripper pair can be run on the rails to grip a lagging sheet end. This gripper pair is preferably braked in order to keep the held sheet securely taut.

The grippers of the sheet transport system preferably each have two clamping jaws, magnets being configured at opposite ends of the rails, viewed in the feed direction, to open the clamping jaws by magnetic force, enabling them to clamp a sheet to be printed at a pick-up device and release it again at a delivery device. The clamping jaws can be squeezed together in simple fashion by a spring element.

To facilitate a simple pick-up and release of the sheets, it is expedient for the rails to diverge at their ends transversely to the feed direction, in the plane of the transported sheet.

Although the present invention relates to a sheet transport system for a rotary printing press and the practical embodiments in the following likewise concern a rotary printing press, the principle underlying the present invention that the grippers engage with side edges of the sheet near its front end, viewed in the feed direction, can also be applied to other processing machines used for flat products. These could include, in particular, all types of copying machines, such as printers based on the principle of toner printing.

BRIEF DESCRIPTION OF THE INVENTION

Other features and advantages of the present invention are derived from the following description of exemplary embodiments, reference being made to the figures, in which.

DETAILED DESCRIPTION

Figure 1:
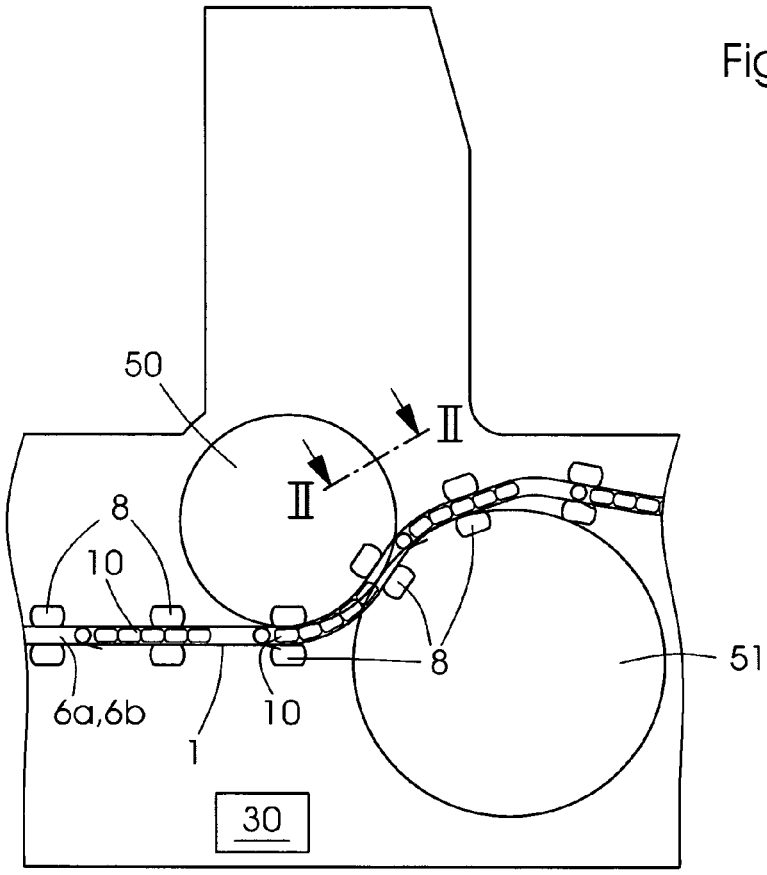
FIG. 1 shows a substantially schematized section through a portion of a printing press having a sheet transport system in accordance with the present invention.

In the print unit of a rotary sheet-fed printing press schematically depicted in FIG. 1, cylinders 50, 51 represent a printing cylinder and a blanket cylinder, respectively, between which a sheet to be printed is guided. A sheet transport system 1 includes two guide rails 6*a*, 6*b*, disposed one behind the other, normal to the drawing plane, in which driving elements 10 constructed of individual chain links of magnetizable material are run, and drive stations 8 configured above and below guide rails 6*a*, 6*b* are driven. Drive stations 8 each include electromagnetic coils, which are selectively excited by a control circuit 30 to regulate the forward motion of individual driving elements 10 in each rail 6*a*, 6*b*.

Figure 2:
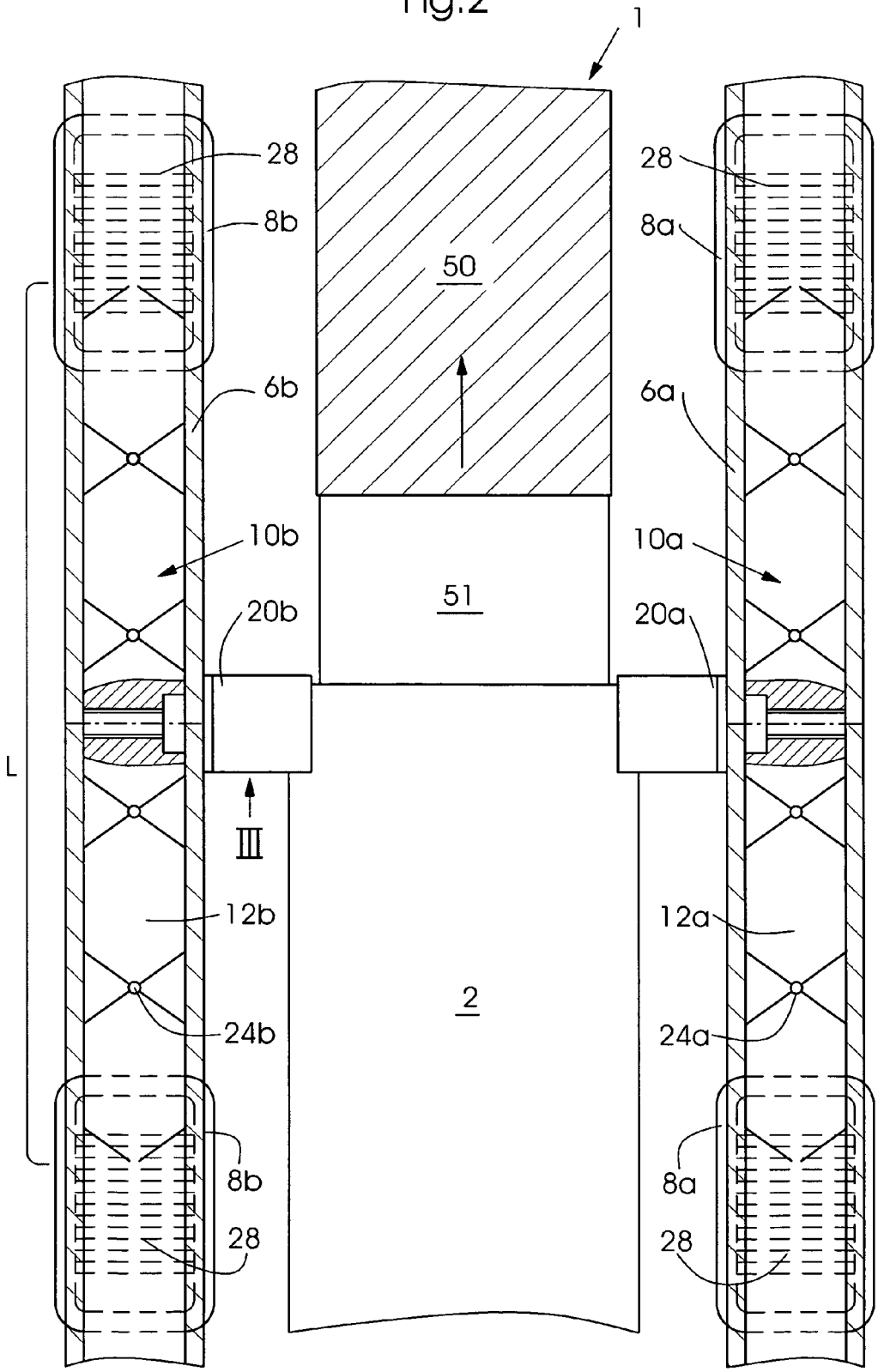
FIG. 2 shows a plan view of the transport system having a sheet guided between two grippers.

FIG. 2 is a detailed illustration of the sheet transport system. It corresponds to a partial section through the upper of the two cylinders 50 along line II—II in FIG. 1 and, respectively, to a plan view of lower cylinder 51, including a sheet 2 guided over it.

Sheet transport system 1 includes two guide rails 6*a*, 6*b*, which extend in the figure to the right and left of cylinders 50, 51. Components in the two guide rails are differentiated in the following by the letters a and b, respectively, depending on whether they belong to the right or left rail.

Figure 5:
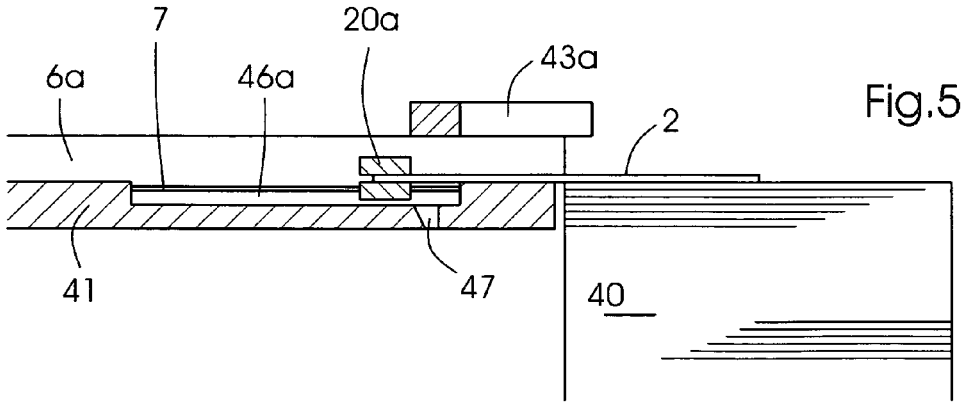
FIG. 5 shows a section through the feeder of FIG. 4, along line V—V.

Guided, respectively, in rail 6*a* and 6*b*, depicted in section, are driving elements 10*a* and 10*b*, which comprise a plurality of chain links 12*a*, 12*b* articulated by joints 24*a*, 24*b* that are rotatable about an axis normal to the drawing plane. The length of driving elements 10*a*, 10*b* is selected so that each driving element is always subject to the magnetic force of at least one of drive stations 8*a*, 8*b*, arranged at uniform distances on the rails. One of chain links 12*a*, 12*b* of each drive element supports a gripper 20*a*, 20*b*, which, through a longitudinal slot 7 (see FIG. 5) of guide rail 6*a* and 6*b*, respectively, meshes with the interspace between the two rails. Grippers 20*a*, 20*b* hold sheet 2 in each case on a longitudinal edge near its front transverse edge, viewed in the feed direction. The width of sheet 2 is slightly greater than the active width of cylinders 50, 51, and grippers 20*a*, 20*b* hold sheet 2 on an area of the sheet that extends beyond the width of cylinders 50, 51, in the direction of guide rails 6*a* and 6*b*, respectively. This rules out any chance of grippers 20*a*, 20*b* coming in contact with the surfaces of cylinders 50, 51. In the event that an error occurs when the movements of drive elements 10*a*, 10*b* and of cylinders 50, 51 are electronically synchronized by control circuit 30, at most, this can result in the image to be printed by the cylinders on sheet 2 being incorrectly positioned, but not in any danger whatsoever of damage. No provision is made for a mechanical coupling of grippers 20*a*, 20*b*, as provided, for instance, by the cross bar known from the German Patent Document No. 2 501 963. The synchronization of the motion of drive elements 10*a*, 10*b* required to evenly guide sheet 2 is achieved in that control circuit 30 drives each of the mutually opposing drive stations 8*a* and 8*b*, respectively, of the two rails in the same way. Here as well, the need is eliminated for a mechanical forced coupling of the two grippers 20*a*, 20*b*, without this leading to a loss of operational reliability of the transport system, i.e., of a printing press equipped with the transport system. This is due to the fact that in the case of the transport system according to the present invention, any lack of synchronicity in the movement of two grippers holding a same sheet can lead to the sheet to be transported tearing, not, however, to a canting of the transport system and, thus, also not to mechanical damage to this or other parts of the printing press.

Figure 3:
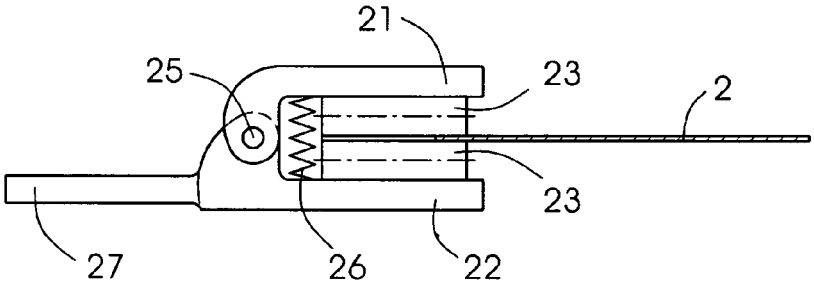
FIG. 3 shows a side view of a gripper in a first refinement.

FIG. 3 depicts a view of gripper 20*b* of FIG. 2, viewed from the direction of arrow III in FIG. 2. The gripper is designed as a type of clamp, having two jaws 21, 22, articulated at a joint 25 and, at their mutually facing inner sides, bearing retaining members 23, whose material contacts the material of the sheet with a high coefficient of friction. In the normal transport state of the gripper shown in the figure, a tension spring 26 keeps the two jaws 21, 22 pressed against one another. An arm 27 is used to secure the gripper in one of links 12*a*, 12*b* of drive element 10. Upper jaw 21 of the gripper that is able to swing via joint 25 toward arm 27 is at least partially made of a magnetic, preferably soft magnetic material, as are chain links 12*a*, 12*b*.

Figure 4:
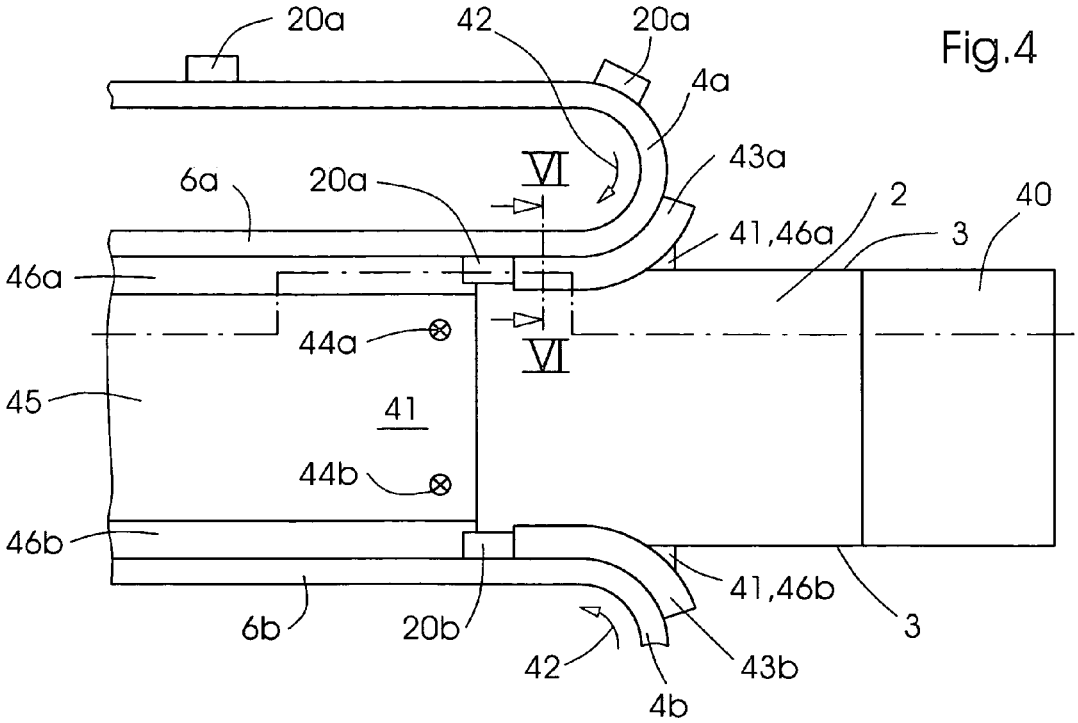
FIG. 4 shows a schematic plan view of the feeder area of a printing press having a sheet transport system in accordance with the present invention.

FIG. 4 shows a plan or top view of a feeder region of the sheet transport system according to the present invention. The same feeder region is illustrated in section, in FIG. 5, along line V—V of FIG. 4. A sheet pile 40 is arranged at the pick-up edge of a feeding table 41 and kept at a level where top-most sheet 2 of the pile 40 can be slid by a separating device (not shown) onto feeding table 41 into the position shown in FIGS. 4 and 5.

Guide rails 6*a*, 6*b* each form a closed circuit in which grippers 20*a*, 20*b* circulate in pairs, synchronously in the direction of arrows 42. The circuit includes an intake section 4*a*, 4*b* in the vicinity of the pick-up edge of feeding table 41, in which rails 6*a*, 6*b* run toward each other in the transport plane of sheet 2, and contiguous thereto, a transport section, where they run in parallel. In intake section 4*a*, 4*b*, grippers 20*a*, 20*b* pass through underneath magnets 43*a*, 43*b* mounted above rails 6*a*, 6*b*, the magnets exerting a force of attraction on upper jaw 21 of each gripper, lifting it opposite the force of tension spring 26. Thus, when passing through underneath magnets 43*a*, 43*b*, the grippers are in an open position or setting. In this position, they approach the sheet to be transported, from the side, to the point where side edges 3 of the sheet engage between jaws 21, 22. Typically, the depth of engagement can amount to 5 to 10 mm.

The separating device places sheet 2 with its front edge, viewed in the feed direction, disposed more or less at the level of the rear ends of magnets 43*a*, 43*b*. At this location, grippers 20*a*, 20*b* leave the field of magnets 43*a*, 43*b*, so that their jaws close, grasp side edges 3 of sheet 2, and transport sheet 2 away from the illustrated position.

FIG. 4 depicts a pair of grippers 20*a*, 20*b*, at the moment when they close at the level of the front edge of sheet 2.

Two sensors 44*a*, 44*b* are flush-mounted transversely to the feed direction of sheet 2, spaced apart from one another in the surface of feeding table 41. These sensors detect the instant when they are crossed over by a sheet that is grasped by one of grippers 20*a*, 20*b* and being carried away from the position shown in FIG. 4. This detection makes it possible for control circuit 30 to precisely determine the position of sheet 2 in relation to the printing press, independently of how the sheet had been grabbed by grippers 20*a*, 20*b*. This is useful, since the position of the sheet in relation to a gripper can fluctuate to a certain extent from one feed operation to the next. The control on the basis of the detection results of sensors 44*a*, 44*b* makes it possible, on the one hand, to compensate for any skewing of sheet 2, in that the two grippers 20*a*, 20*b* holding sheet 2 are driven in slight variation, and, on the other hand, to synchronize the position of the front edge of sheet 2 precisely with the motion of printing cylinders 50, 51, for example a blanket cylinder and an impression cylinder.

To run a sheet through the printing press, it suffices, in principle, when the sheet is gripped at its front edge and pulled through the press. However, for a precise, balanced guidance of the sheet, it is desirable for it to be held at more than one location along its longitudinal edges. This can be easily done using the transport system according to the present invention, since the individual drive elements 10*a*, 10*b* are not coupled to one another and, in general, are able to be driven, independently of one another, by the individual drive stations 8*a*, 8*b*. Control circuit 30 can drive the drive stations in such a way that, in each case, two successive grippers circulate at such a distance along guide rails 6*a*, 6*b* that a first gripper receives a sheet to grasp near its front edge, and a following gripper grasps it at a location disposed further behind, preferably at the level of its rear edge. Applying a slightly greater driving-force to the front gripper than to the gripper that follows enables the sheet to be conveyed through the printing press, stretched tightly (taut) under a substantially arbitrarily selectable initial tension.

The feeding table of FIG. 4 has a central bearing surface 45 and in each case, between bearing surface 45 and guide rails 6*a*, 6*b*, deep-set channels 46*a*, 46*b* for receiving lower jaws 22 of grippers 20*a*, 20*b* during their feed motion. To prevent the side edges of one sheet having little inherent rigidity from hanging down into these channels 46*a*, 46*b* before they can be grasped by grippers 20*a*, 20*b*, it is useful to provide air vents 47 at the base of these channels, in particular below magnets 43*a*, 43*b*, to release a dosed air flow to hold the edges of sheet 2 at a level where they can be grasped by grippers 20*a*, 20*b*.

Figure 6:
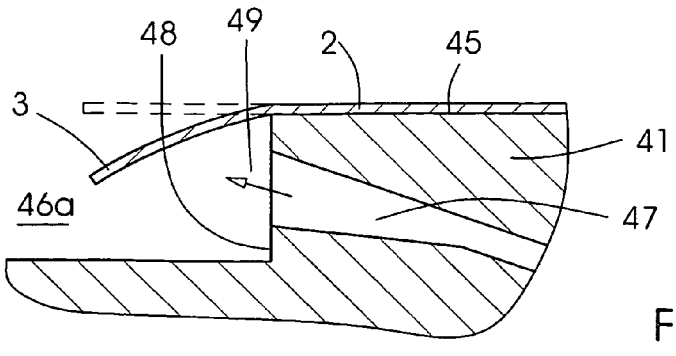
FIG. 6 shows a detail of the feeder of FIG. 4, in a section along line VI—VI.

In a cross-section along line VI—VI of FIG. 4, FIG. 6 shows a preferred arrangement of air vents 47 on an enlarged scale. Here, air vent 47 extends diagonally below bearing surface 45 of feeding table 41, and is open at a side wall 48 of channel 46*a*. An air flow emerging from the air vent in the direction of arrow 49 lifts side edge 3 of sheet 2 out of the position shown with a solid line into a position shown with a dotted line, where it essentially comes into alignment with the part of sheet 2 resting on bearing surface 45. At the same time, the air flow exerts a tensile force in the lateral direction, on side edge 3, stretching the sheet transversely to its feed direction. With this measure, even sheets 2 having little intrinsic rigidity are able to be securely grasped by grippers 20*a*, 20*b*, without the danger of side edge 3 colliding with lower jaw 22 of a gripper and buckling in the process.

Figure 7:
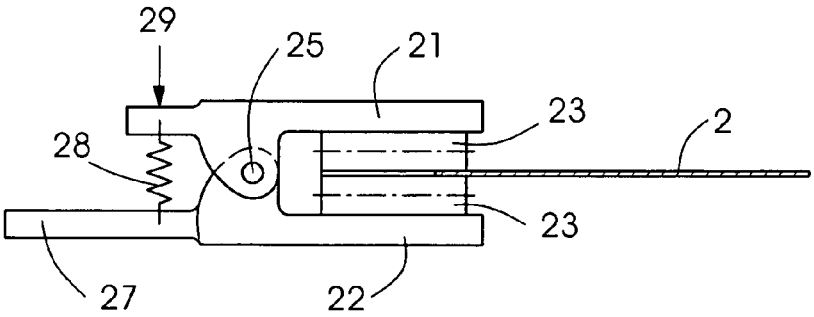
FIG. 7 shows a side view of a gripper in accordance with a second variant.

FIG. 7 depicts a second variant of a gripper. Parts which correspond to those of the gripper of FIG. 3 bear the same reference numerals and are not described once more. In place of a tension spring, a pressure spring 28 is provided, which is arranged between arm 27 and an extension prolongation of upper jaw 21. A force 29 acting from above on the extension prolongation allows the gripper to open. A gripper of this kind can be used, for example, in a transport system having a feeder similar to that of FIGS. 4 and 5, magnets 43*a*, 43*b* being replaced by pressure profiles underneath which the extension prolongation slides along and which press down the extension prolongation, while the gripper moves from the side toward the side edges of a sheet to be grasped.

Provision is made in each case at the distributor of the sheet transport system at guide rails 6*a*, 6*b* for an outlet region or delivery end region, which is designed analogously to the intake region 4*a*, 4*b*. There, other magnets or pressure profiles, are provided for opening the grippers and for releasing the printed sheet on a storage pile. The opened grippers 20*a*, 20 move away from one another on the rails 6*a*, 6*b*, which diverge in the outlet section, and are transported back to intake region 4*a* and 4*b*, respectively.

"Gripped near the front end" as defined herein is defined to mean that the paper is gripped at least between the front end of the sheet and a halfway point between the front end of the sheet and the rear end of the sheet so that the sheet can pass operatively though the printing press without error due to the drooping or bending of the front end.

What is claimed is:

1. A rotary printing press with a sheet transport system comprising:

two cylinders forming a nip;

a first rail configured on one side of a sheet transport path and a second rail configured on the other side of the sheet transport path; and at least one first driven gripper being guided on the first rail and at least one second driven gripper being guided on the second rail, the at least one first gripper and the at least one second gripper pulling a sheet to be conveyed in a feed direction, the sheet having a first side edge, a second side edge and a front end with respect to the feed direction, the at least one first gripper engaging the first side edge of the sheet near the front end of the sheet, the at least one second gripper engaging the second side edge of the sheet near the front end of the sheet, the at least one first gripper being mechanically decoupled from the at least one second gripper;

wherein the first and second rails run along the nip.

2. The rotary printing press with the sheet transport system as recited in claim 1 further comprising a feeder and a delivery device, wherein the first and second rails run continuously between the feeder and the delivery device.

3. The rotary printing press with the sheet transport system as recited in claim 1 further comprising an electronic control circuit for synchronizing the motion of the first and second grippers with the rotation of cylinders of the rotary printing press.

4. The rotary printing press with the sheet transport system as recited in claim 3 wherein the control circuit synchronizes the motion of the first grippers and second grippers.

5. The rotary printing press with the sheet transport system as recited in claim 1 wherein the first and second grippers hold the sheet in an area of the sheet that extends beyond a width of the cylinders.

6. A method for transporting a sheet having a front edge and a first side edge and a second side edge in a rotary printing press comprising:

gripping the first side edge near the front edge with a first gripper;

gripping the second side edge near the front edge with a second gripper mechanically decoupled from the first gripper; and moving the first and second grippers on rails configured on both sides of a sheet transport path so as to move the sheet along the sheet transport path.

7. The method as recited in claim 6 further comprising gripping the first side edge at a rear of the sheet with a third gripper.

8. A sheet transport system for a rotary printing press comprising:

a first rail configured on one side of a sheet transport path and a second rail configured on the other side of the sheet transport path; and at least one first driven gripper being guided on the first rail and at least one second driven gripper being guided on the second rail, the at least one first gripper and the at least one second gripper pulling a sheet to be conveyed in a feed direction, the sheet having a first side edge, a second side edge and a front end with respect to the feed direction, the at least one first gripper engaging the first side edge of the sheet near the front end of the sheet, the at least one second gripper engaging the second side edge of the sheet near the front end of the sheet, the at least one first gripper being mechanically decoupled from the at least one second gripper.

9. The sheet transport system as recited in claim 8 further comprising at least one pair of lagging grippers running on the first and second rails to grip a lagging end of the sheet.

10. The sheet transport system as recited in claim 9 wherein the lagging gripper pair is braked.

11. The sheet transport system as recited in claim 8 wherein the first and second driven grippers each include two clamping jaws, and further comprising magnets arranged at at least one of an intake area and at an outlet area of the first and second rails for opening the clamping jaws by magnetic force.

12. The sheet transport system as recited in claim 11 wherein the clamping jaws are forced together by a spring element.

13. The sheet transport system as recited in claim 8 further comprising an intake area for the sheet and an outlet area, wherein the first and second rails diverge at at least one of the intake area and the outlet area transversely to the feed direction, in a plane of the transported sheet.

* * * * *